United States Patent [19]

Knorr

[11] 4,213,287

[45] Jul. 22, 1980

[54] FILLING MACHINE FOR VALVE BAGS

[75] Inventor: Günter Knorr, Hamburg, Fed. Rep. of Germany

[73] Assignee: Claudius Peters AG, Hamburg, Fed. Rep. of Germany

[21] Appl. No.: 29,893

[22] Filed: Apr. 13, 1979

[30] Foreign Application Priority Data

Apr. 21, 1978 [DE] Fed. Rep. of Germany ..... 2817436
May 24, 1978 [DE] Fed. Rep. of Germany ..... 2822678

[51] Int. Cl.[2] ..... B65B 43/26
[52] U.S. Cl. ..... 53/573; 141/313
[58] Field of Search ..... 53/571, 573; 141/313, 141/314, 315, 316

[56] References Cited

U.S. PATENT DOCUMENTS 3,466,837 9/1969 Sturges ..... 53/373 X
3,989,073 11/1976 Remmert ..... 53/571 X

*Primary Examiner*—Travis S. McGehee
*Attorney, Agent, or Firm*—Otto John Munz

[57] ABSTRACT

A filling machine for valve bags as a plurality of filling caps for filing bags supplied thereto from a magazine, and includes a rotating structure which carries a plurality of articulated delivery arms which grip the bags at the magazine and deliver them to the filling caps where the bags are filled with product. The delivery arms are constructed and guided in their movement such that they have a very slow approach to the bags and thus are enabled to accurately grip the bags.

19 Claims, 8 Drawing Figures

FILLING MACHINE FOR VALVE BAGS

BACKGROUND OF THE INVENTION

The invention relates to a filling machine for valve bags or the like with a plurality of filling caps rotatably mounted on a rotor, a stationary magazine, and an automatic delivery and slip-on device which consists of delivery arms mounted on the rotor and associated each with a filler cap, said arms being movable about a delivery shaft positioned transversely to the cap direction so as to bring a gripping device arranged at the end of the arm from a position close to the magazine into the slip-on position on the cap.

PRIOR ART

In a known filling machine of this type ("Zement-Kalk-Gips"—"Cement-Lime-Gypsum"—1978, p. 155), the gripping device moving in full peripheral movement seizes the bags kept ready at the stationary magazine. This is only possible when the valve of the bags to be seized are kept ready in the direction of the movement of the gripping devices, in tangential direction to the rotor, which, however, requires a complicated supply mechanism. Besides, such structure presents the disadvantages that the relative movement, which continues during the gripping, between the gripping device and the bag may cause gripping inaccuracies. German Auslegeschrift No. 1,101,264 is an example of a further prior art device.

SUMMARY OF THE INVENTION

The invention is based on the problem of creating a filling machine of the kind initially mentioned which permits accurate gripping of the bags independently of the position wherein they are kept ready.

The invention offers a solution in which each transfer arm is movable not only around the axis intended for the transfer motion, but also around the axis running diagonally to its circular direction (compensating axis). Each transfer arm is controlled by the magazine for a balance of the relative motion against its circular motion.

Due to the fact that the arm is steered or guided, during the gripping, in the magazine area in a direction opposite to that of its rotation, the speed od the gripping device relative to the object to be seized is diminished and preferably reduced to zero. This improves the accuracy of the grip and the careful treatment of the bags in the gripping.

To be sure, it is known (German Auslegeschrift No. 1,101,264) to eliminate the relative movement between a stationarily arranged delivery arm and the rotating filler cap of a filling machine by suitable lateral mobility of the delivery arm during the slipping-on; this, however, requires a very complicated construction, so that it has not been considered conceivable to employ such a structure in the case of rotating arms which are provided in a number corresponding to the number of caps, with the result that the expenditure is multiplied in comparison to that with a stationarily arranged delivery arm, and with which arms the rotating masses must be small. The provision, according to the invention, of the delivery arm with the addition of a differential pinion shaft, however, permits an inexpensive and easy construction.

A very important advantage of the invention consists in that the compensating movement about the differential pinion shaft is combined with a lengthening and shortening of the arm. When the arm is pivoted on the differential pinion shaft forward or backward in the direction of rotation, it presents a less wide radial range than when it is in a central position. This can be utilized for the execution of the gripping movement by having the steering or guiding of the arm carried out in such a way that the gripping device in the gripping is advanced toward the object while it is being withdrawn before and/or after the gripping by corresponding pivoting. This facilitates the gripping of objects positioned transversely to the peripheral direction. In such objects, wherein of course the gripping direction must agree with the longitudinal direction of the objects, the differential pinion shaft is therefore suitable arranged in a direction parallel to the gripping device direction or object direction. When a valve bag is to be seized, object direction means the longitudinal direction of the bag edge which forms the valve.

In such tasks, the arm is suitably steered in such a manner that the opening direction of the gripping device constantly faces the portion to be seized during the approach. In fact, in this process, during the approach the gripping device is gradually slipped over the portion to be seized, so that the closure of the gripping device can take place, without haste, in the area of closest approach. In such a case, it is suitable that the arm when approaching the magazine or the object to be seized is initially kept at an angle which advances, with respect to the radial plane that corresponds to the maximum extension of the arm so as to gradually assume, at further approach, the elongated position. For this purpose, the arm is suitably loaded with a flexible force bringing about an advance pivoting. This force may be formed by a spring, a pneumatic cylinder steadily acted upon, gravity, or centrifugal force.

The differential pinion shaft may be provided at the end of the arm that is distant from the gripping device, in the vicinity of the delivery shaft. In some case it is, however, more advantageous to arrange it more closely to the gripping device. The smaller the distance between the differential pinion shaft and the gripping device, the smaller the circumferential arc can be on which the elongation and withdrawal movement of the arm takes place. The smaller also are the masses affected by the compensating movement.

The compensating movement of the arm is suitably controlled by means of a stationary guide curve. This guide curve may be in a fixed location relative to the magazine, so that each arm that approaches the magazine positively carries out the same compensating movement. Adjustment operations are also substantially simplified thereby since they may be carried out in the stationary magazine area only and not (in a corresponding multiplicity) on the individual arms.

For the movement of the arm into the gripping position at the magazine, and generally also for the movement of the arm in the immediate magazine area, a forced or positive guiding is suitably provided. Subsequently, however, the arm may be left more or less to free movement. It pivots then under the effect of the participating masses, and possible of the supporting effect of the flexible force mentioned above, from its position which has remained somewhat behind during the gripping with respect to the movement of rotation, forward again. This free movement is advantageous not only because it saves special devices for the forced guiding of the arm in this phase of the movement, but also because then also the smallest forces occur on the arm and on the seized object.

In this free movement after a certain time which may be predetermined, the arm reaches the position corresponding to the slip-on direction. Suitable arresting devices are provided which hold it in this position so that in the subsequent delivery movement it correctly engages the filler cap.

When the gripping device releases its grip, the arresting device can also be released in order to bring the arm into the position, preferably advance, wherein it is ready for the next gripping action.

It is advantageous that the differential pinion shaft be essentially horizontally arranged. The reason for this is that the elongation and withdrawal of the arms connected with the compensating movement thereby takes place essentially in vertical direction, so that the gripping device can reach down from above to a lying object, such as the valve edge (disposed in horizontal position) of a valve bag. However, a vertical or slanting arrangement of the differential pinion shaft is possible when the object to be seized can be disposed or supplied in another position.

Frequently it is desired that the valve part of the bag be horizontal both in the seizing position as well as during the slipping on upon the filler cap. In this case an arm with a parallel construction device is employed, such as of a parallelogram linkage construction or another parallel construction gear. In such a case the whole arm is suitably divided into a parallel construction section distant from the gripping device and a gripping section close to the gripping device, the compensating joint being arranged between these two arm sections.

When, in connection with the invention, the magazine is mentioned, the portion associated with the magazine that holds the bag to be seized is intended to be included, and eventually with a pre-opened valve.

OBJECTS OF THE INVENTION

An object of the invention is to provide a simple and economical filling machine for bags wherein the bags are delivered from a magazine to a filling station by at least one delivery arm which accurately grips the bag.

Another object is to provide a filling machine for valve bags, wherein bags to be filled may be accurately gripped and delivered to a filling station by a gripping device carried by at least one delivery arm which is pivoted about an axis to compensate for the speed of movement of the gripping device toward the bag, whereby the relative movement between the gripping device and bag is very low during gripping of the bag.

In a modification of the invention, the delivery arm carries out the delivery movement not in the form of a pivoting about a delivery shaft, but by an essentially rectilinear motion along a guide. In other words, each arm consists of an essentially radial guide element provided on the rotor, and a gripping element attached to the guide element. In this structure, the differential pinion shaft is suitable arranged in the area of the gripping arm.

DETAILED DESCRIPTION OF THE PREFERRED EMBODIMENTS

Figure 1:
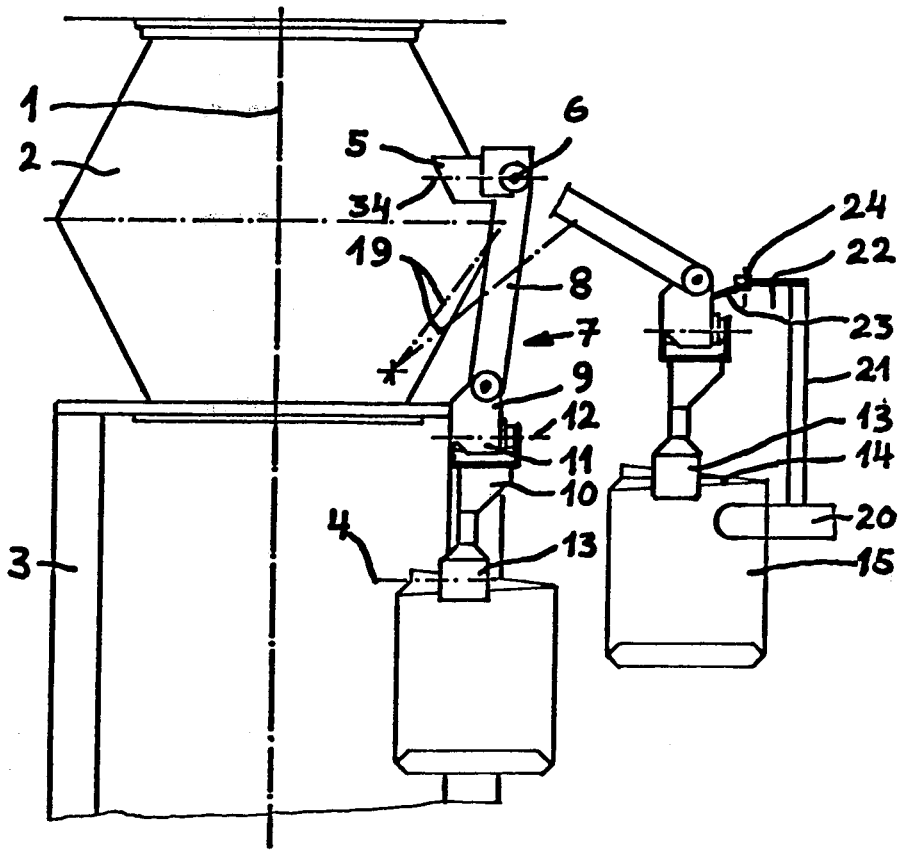
FIGS. 1 and 2 are side views in elevation of a first embodiment.

In the drawings, wherein like reference numerals refer to like parts throughout the several views, elements 2 and 3 comprise rotating elements or rotors of the filling machine, which rotate about vertical axis 1, and which can be of known type. They carry a number such as 6, 8 or 12, of filler caps uniformly distributed over the periphery. The center line 4 of a filler cap appears in the FIGS. 1 and 3 as dot-and-dash line, and in FIG. 2 as a point. The other filler caps are omitted in the drawing for the sake of simplicity.

The delivery arm, generally marked 7, associated with filler cap 4 is mounted on the rotating machine part 2 on a rigid support 5 so as to pivot about the horizontal delivery shaft 6. Pivoting of the arm about shaft 6 serves to bring about the delivery movement from the gripping position, shown on the right in FIG. 1, and the slip-on position, shown on the left in FIG. 1. Arm 7 consists of two sections, namely a parallel construction section 8 ending in a block 9, and a gripping section 10 which is fastened by means of a compensating joint 11 with rotating shaft 12 to block 9. The gripping section supports the gripping device 13 whose gripping direction can be indicated through filler cap direction 4 or the direction of the valve edge 24 of the valve bag 15. The gripping device comprises two gripping jaws 16 (FIG. 6) pivotable about the axis of gripper joint 17 which is parallel to the gripping direction.

Delivery shaft 6 is essentially tangential to the rotating parts 2 and 3 and perpendicular to filler cap direction 4. In the case shown, the plane wherein the delivery movement of arm 7 is carried out is not exactly radial but somewhat displaced with respect to the radial plane in the direction of rotation (arrow 18 in FIG. 4). The terminal positions which can be assumed by the parallel construction section 8 of arm 7 and which are associated with the gripping position or the slip-on position, are precisely fixed by conventional structural means. For the delivery movement, suitable drive means are provided, such as a piston and cylinder device, which are schematically indicated in FIGS. 1 and 2 by dot-and dash lines 19.

Figure 3:
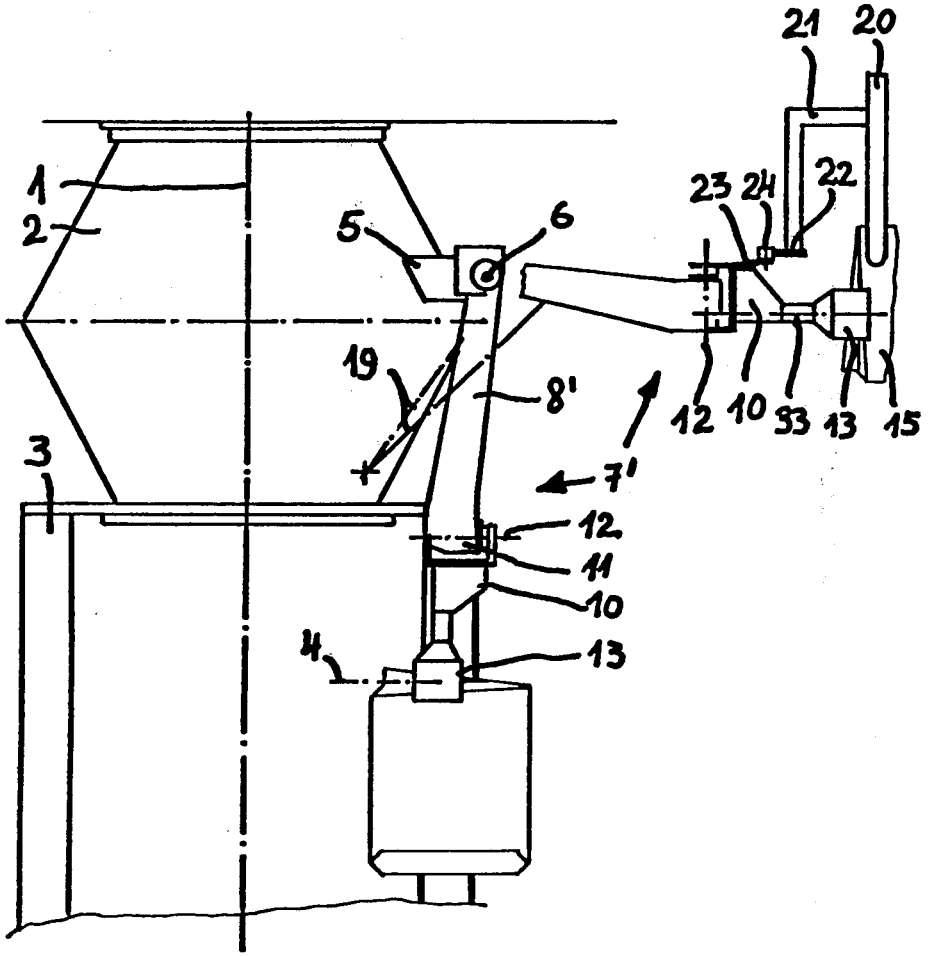
FIG. 3 is a side view corresponding to FIG. 1, of a second embodiment.

The gripping and slip-on positions of arm 7 shown in FIGS. 1 and 3 are, of course, associated with different areas of rotation of the machine.

In the gripping position, the arm cooperates with a stationary magazine, indicated at 20 in FIG. 1, which keeps the valve bag 15 to be seized ready in a predetermined position. This magazine is rigidly connected via a strut 21 with a control curve or cam 22. A control lever 23 is mounted on block 9 and has a terminal roll 24 or follower which cooperates with cam 22. Lever 23 acts upon a gear provided in block 9, which in turn determines the angular position of gripping section 10 of the arm with respect to joint 11.

Figure 2:
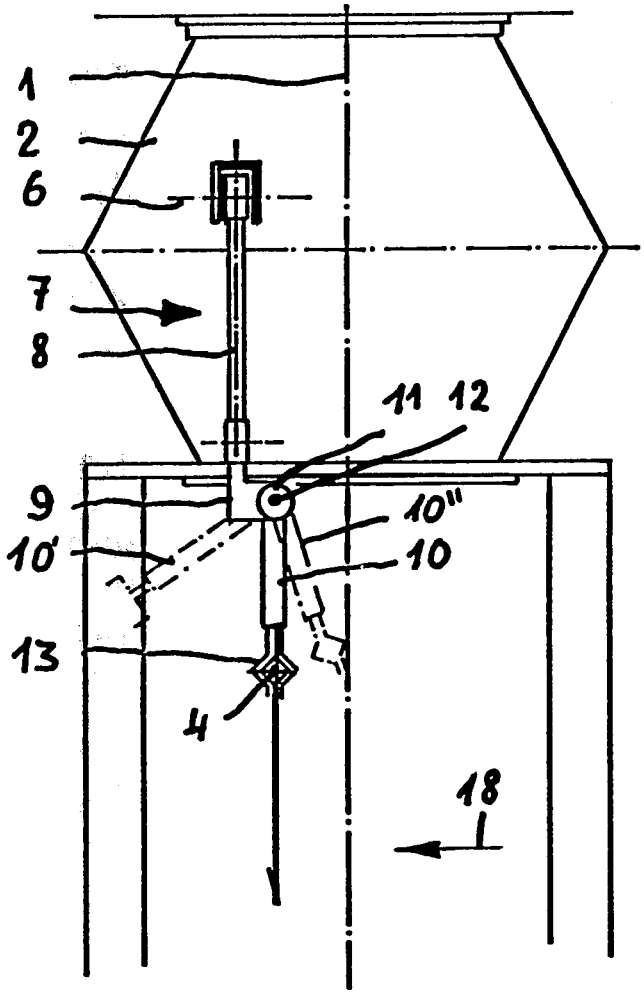
Figure 4:
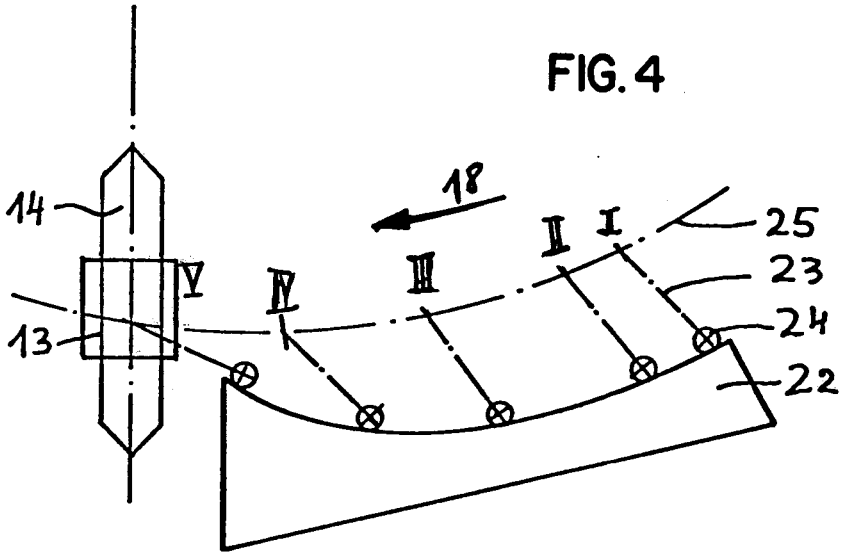
FIG. 4 is a diagrammatical plan view upon the curve control for the compensating movement.
Figure 5:
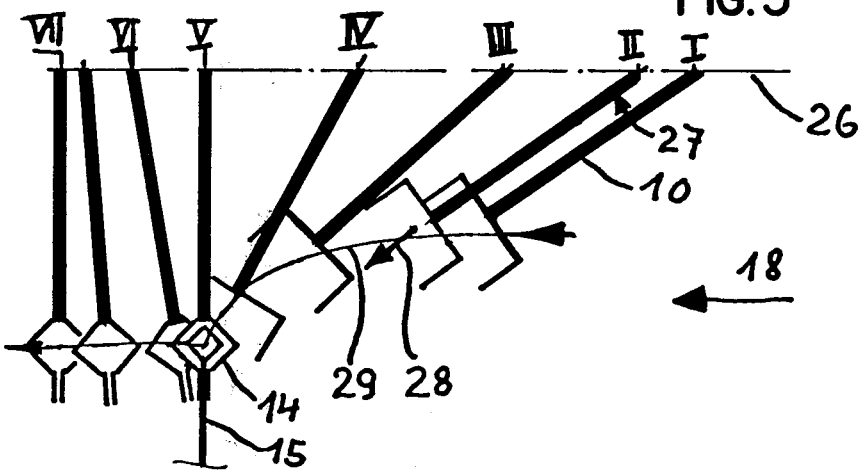
FIG. 5 is a diagrammatic, partially developed view of the arm during the compensating movement.

FIG. 2 shows that gripping section 10 of arm 7 (shown in slip-on position by full lines) is pivotable to the positions shown in dot-and-dash line representations; in position 10' it is shown advanced in the direction of rotation 18 with respect to the mid-position while in position 10'' it is shown behind. It is pushed by a spring (not shown) into the position of advance 10'. By the cam 22 it can be retained with respect to the position of advance 10'. The manner of how this takes place at the approach to the magazine and to the gripping position is shown in FIGS. 4 and 5. Under the condition that arm 7 was previously pivoted outward as far as possible, the pivot point about which control lever 23 pivots relative to block 9, moves on a circular arc 25. In this process it passes through various positions I to V wherein control lever 23 and its terminal roll 24 assume the different positions shown. The other structural elements are not shown. Only in the last position V, which is the gripping position, is the gripping device 13 shown, with the seized valve edge 14 of a valve edge. The drawing shows that the angle of lever 23 increases with respect to the radius with progressing approach to gripping position V.

The successive positions of gripping section 10 of arm 7, shown in developed view in FIG. 5, correspond to the positions of control lever 23 shown in FIG. 4. In FIG. 5, the dot-and-dash line 26 represents the development of the circular path whereon the compensating axis 12 of gripping section 10 moves.

In the Position I, gripping element 10 is in that angular position advancing with respect to the direction of rotation into which it is pushed by the flexible force 27. The position of control lever 23 shown in FIG. 4, Position 1, corresponds to this position. In Position II, the angular position has changed very little since the terminal roll 24 of control lever 23 has just come in contact with cam 24. However, it is evident that in Position III the lead angle of the gripping device 10 has decreased, namely in such a way that the opening direction of the gripping device, indicated in Position II by arrow 28, remains directed toward the object to be seized which at 14 is kept stationary at the magazine. In this process, the middle of the gripping device describes a curve 29. It can be seen that in Position IV the gripping device has closely approached object 14 and already partialle embraces the latter. In this process it descends according to curve 29 upon the object. It is thus increasingly elongated or moved forwardly toward the object relative to line 26. Finally, in Position V, in the gripping position, the gripper has completely seized object 14. By known devices, not explained in detail, the gripping device is closed in this position so that it firmly holds edge 14 of valve bag 15.

It is obvious that in the last phase of movement line 29 approaches the gripping position almost vertically, with the horizontal speed component of the gripping device decreasing. In other words, cam 22 is designed in such a way that the relative speed of the gripping device with respect to the magazine becomes very small, and if possible approaches zero in the gripping position. Thus, FIG. 5 shows very clearly that the invention simultaneously accomplishes two advantageous aims, namely, in the first place, the retardation of the gripping device with respect to the speed of rotation, in order to be able to seize the object accurately and in a careful manner, and secondly, the approach of the gripping device to the object to be seized transversely to the direction of rotation, so that a simple, symmetrically shaped pincer-like gripping device can be used.

When the arm leaves gripping Position V, terminal roll 24 of control lever 23 departs from cam 22. The gripping section 10 of the arm is therefore then free in its movement. It first remains somewhat behind in Position VI because the gripping device with the seized object must be accelerated, and it swings forward then on the basis of the totality of the forces acting upon it, especially on the basis of the flexible force 27, until it has reached Position VII, wherein it stands essentially in vertical position. In this position it is locked so as to retain the correct position for the slipping-on of the bag upon a filler cap (the center line of which is indicated in dot-and-dash line at 4).

In deviation from the mode of operation shown, it is also conceivable to lock arm section 10 in Position V. This, however, would entail the disadvantage that the locking would have to absorb strong forces because the gripping device, whose speed is zero, would have to be accelerated sharply to the speed of rotation. These forces are reduced to a minimum by leaving the arm section between Positions V and VII to the free, after-swinging movement.

Figure 6:
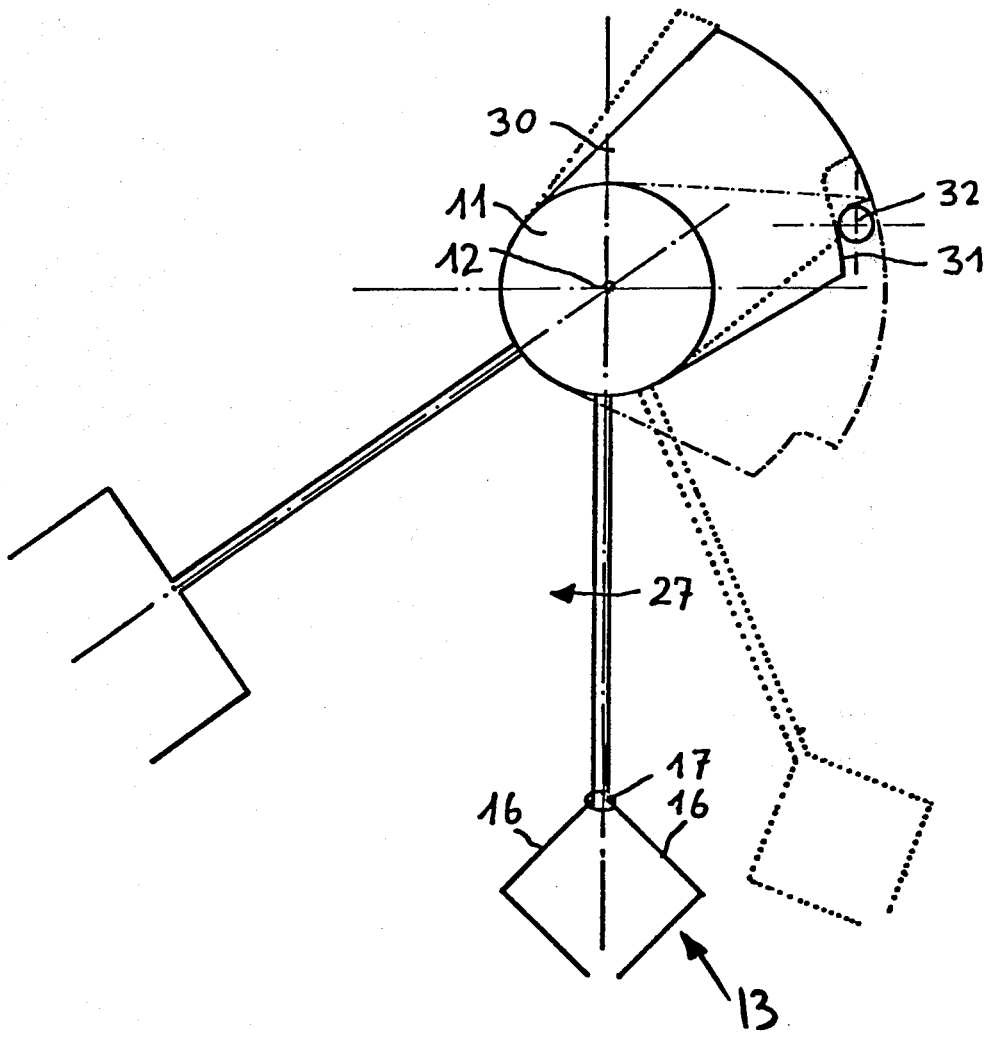
FIG. 6 is a diagrammatical view of an arm and an arresting device associated therewith.

Such an arresting device is illustrated in FIG. 6. Gripping section 10 of the arm is connected in the area of joint 12 with a rotating shaft 30 which is provided at 31 with a locking recess cooperating with a locking pinion 32 which is displaceable on block 9 in its longitudinal direction, and therefore parallel to joint axis 12, in such a manner that it is located selectively inside the movement area of rotating shaft 30 or outside thereof. It is pressed by spring force into the moving area of the rotating shaft. The rotating shaft is so wide that it covers pin 32 even in the farthest advanced position, indicated in dot-and-dash lines, of arm section 10, so that pin 32 under the spring force can snap forward only when the arm section has been returned into the vertical position, shown in full lines, or the position further back, as indicated in dotted lines.

The dotted position is the one which arm section 10 assumes in Position VI according to FIG. 5. When arm section 10 under the force that effects it swings in the direction of the arrow, its movement is stopped in vertical position by pin 32 and thus the arm section is arrested in its position. When the gripping device is opened after the slipping-on, pin 32 is also withdrawn, so that the device is released and the gripping device can advance to the position shown in dot-and-dash lines. Immediately after, pin 32 can be freed again from the force withdrawing it, so that it is pushed under spring force into the area of movement of rotating shaft 30. It can, however, exert its locking effect again when rotating shaft 30 during the following gripping action has at least reached its vertical position again, without impeding the free after-swinging between Positions V and VII of FIG. 5.

The embodiment of FIG. 3 differs from those of FIGS. 1 and 2 in that part 8' of arm 7 is not of parallel construction. Gripping section 10 of arm 7 shares therefore the angular movement of arm section 8' during the delivery movement. This means that the gripping device direction which agrees with the slipping-on position of the filler cap device direction 4, is vertical in a delivery pivoting movement of 90° from the gripping position, and that therefore the valve bags 15 must be supplied in the corresponding position. The arm, which is free of parallel construction is simpler instructure, especially since a separate gear between control lever 23 and gripping section 10 of the arm can be eliminated because the direction movement and the pivoting axis of these elements agree.

If in this simplified arm shape, the bags are to be conveyed not vertically but in horizontal valve edge arrangement, the gripping device may be turned 90° about the longitudinal axis 33 of arm section 10.

A structure wherein only the outer section 10 of arm 7 is pivotable for the compensation of the relative movement in peripheral direction presents advantages. However, in some cases a simplification is achieved by a structure wherein the compensating joint is placed at the gripper device distant end of the arm, since in this case joints 11 and 6 can more or less present a structural unit. For instance, in the embodiment of FIG. 1, joint 12 could be replaced by a structure wherein arm support 5 is mounted so as to rotate about an axis 34 on the rotating machine elements 2. In tne embodiment of FIG. 3, a suitable joint could be provided on arm support 5, which joint must be provided with a vertical differential pinion shaft.

Figure 7:
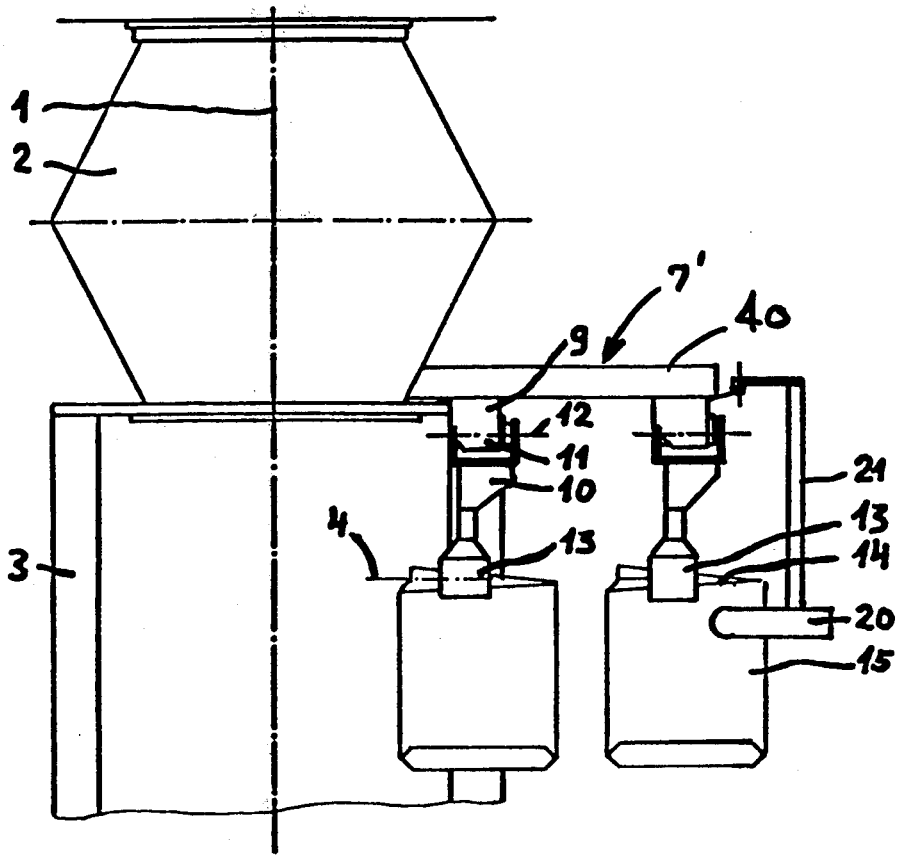
FIG. 7 is a side view similar to FIG. 1, of a second modification of the invention.
Figure 8:
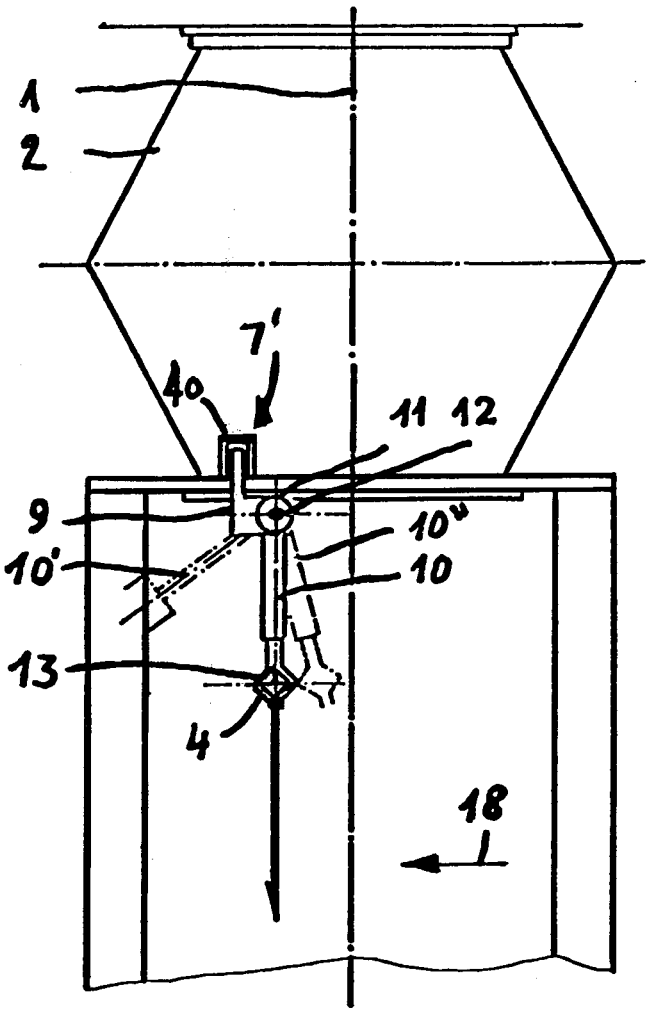
FIG. 8 is a side view at 90° to FIG. 7, and corresponds to FIG. 2.

In the modification shown in FIGS. 7 and 8, the delivery arm is indicated generally at 7'. Arm 7' is composed of two sections, namely a guide element 40 and a gripping element 10 which is fastened by means of a differential joint 11 with a differential pinion shaft 12 to a block 9 and supports at its free end a gripping device 13 which is shaped in such a way that the direction of the object to be gripped by the gripping element can be indicated by the direction of the filler cap 4, or respectively, by the direction of the valve edge 14 of the valve bag 15 which is gripped at the edge.

Guide arm 40 is shaped as a crosshead guide for the block 9 slideable thereon so that the latter can be moved, from the gripping position appearing at the right to the slip-on position shown at the left (and vice versa) by drive means, not shown. The guiding direction of guide element 40 is generally rectilinear, which is generally advantageous but not absolutely necessary for compliance with the basic concept of the invention.

With respect to the details of the operation, and particularly with respect to the compensating movement carried out by gripping element 10, reference is made to the earlier described embodiments.

For the reasons explained in connection with the earlier embodiments, the arrangement of the differential joint 12 on gripping element 10 is suitable. However, it would in principle also be possible to provide the differential pinion shaft at the transition from rotor 2 to guide element 40. When the direction of a differential pinion shaft thus arranged agrees with the longitudinal direction of guide element 40, the function achieved is essentially the same as occurs in the arrangement of the differential pinion shaft in the area of the gripping element. However, other directions of the differential pinion shaft may also be chosen. For instance, the differential pinion shaft may be arranged at the transition from rotor 2 to guide element 40 of arm 7 vertically or in an inclined position between the vertical and the horizontal position.

What is claimed is:

1. A filling machine for filling bags, comprising a rotor having a plurality of filling stations and a delivery arm for each station, the delivery arms each having a gripping device for gripping the bags and being movable relative to a stationary magazine for the bags, and including an articulated section operable to compensate for the rotational speed of the rotor and arms relative to the magazine, whereby the gripping device is caused to move in a direction opposite to the direction of approach to the magazine so that the relative movement between the gripping device and a bag at the magazine is very low during gripping of the bag, thus facilitating accurate gripping of the bag.

2. A filling machine as claimed in claim 1, wherein a cam is positioned to engage a follower on the delivery arm to positively guide the gripping device during the gripping operation.

3. A filling machine as claimed in claim 1, wherein the delivery arm is pivotable about a delivery shaft for movement of the gripping device away from the rotor and toward the magazine and away from the magazine back toward the rotor and a filling station.

4. A filling machine as claimed in claim 3, wherein the arm is pivotable about a second shaft parallel to the delivery shaft, whereby the gripping device maintains a predetermined orientation in a plane parallel to the delivery shaft.

5. A filling machine as claimed in claim 3, wherein articulation of the delivery arm toward the magazine results in the gripping device assuming an orientation disposed at an angle to the orientation of the gripping device, where it is adjacent the rotor and filling station.

6. A filling machine as claimed in claim 3, wherein a cam is positioned to engage a follower on the delivery arm to positively guide the gripping device during the gripping operation.

7. A filling machine as claimed in claim 4, wherein a cam is positioned to engage a follower on the delivery arm to positively guide the gripping device during the gripping operation.

8. A filling machine as claimed in claim 5, wherein a cam is positioned to engage a follower on the delivery arm to positively guide the gripping device during the gripping operation.

9. A filling machine as claimed in claim 1, wherein the articulated section is pivotable about a compensating shaft disposed perpendicular to the axis of rotation of the rotor and parallel to the direction of travel of the gripping device and a bag carried thereby toward the filling station.

10. A filling machine as claimed in claim 2, wherein the delivery arm is free swinging after the gripping device grips a bag and moves past the magazine.

11. A filling machine as claimed in claim 1, wherein the delivery arm includes a portion fixed relative to the rotor and extending outward from the rotor toward the magazine, and a gripping device carried by the fixed portion for movement along the fixed portion from a position adjacent the rotor to a position adjacent the magazine and vice versa.

12. A filling machine as claimed in claim 2, wherein a locking device is associated with the delivery arm to lock the delivery arm in the orientation it assumes at the position of gripping the bag.

13. A filling machine as claimed in claim 12, wherein release means is associated with the arm to release the locking device when the gripping device releases the bag.

14. A filling machine as claimed in claim 11, wherein a cam is positioned to engage a follower on the delivery arm to positively guide the gripping device during the gripping operation.

15. A filling machine as claimed in claim 2, wherein the gripping device is guided such that the opening direction of the gripping device constantly faces the portion of the bag to the gripped.

16. A filling machine as claimed in claim 9, wherein the compensating shaft is positioned more closely to the gripping device than to the rotor.

17. A filling machine as claimed in claim 9, wherein the compensating shaft is essentially horizontal.

18. A filling machine as claimed in claim 1, wherein the delivery arm is biased in the direction toward the magazine as it advances toward the magazine upon rotation of the rotor.

19. A filling machine as claimed in claim 18, wherein a cam is positioned to engage a follower on the delivery arm to positively guide the gripping device during the gripping operation.

* * * * *